US005573685A

United States Patent [19]

Boncaldo

[11] Patent Number: 5,573,685

[45] Date of Patent: Nov. 12, 1996

[54] REMOTE CONTROL ANTIFREEZE DEVICE FOR A VEHICLE LOCKING UNIT

[76] Inventor: Paul J. Boncaldo, 4780 Young Rd., Stow, Ohio 44224-2113

[21] Appl. No.: 596,604

[22] Filed: Feb. 5, 1996

[51] Int. Cl.[6] ..... E05B 17/00; H05B 3/00

[52] U.S. Cl. ..... 219/201; 219/202; 219/535; 219/544; 219/507; 70/431; 340/825.72

[58] Field of Search ..... 219/200–203, 219/535, 204, 544, 507; 70/431; 340/825.72, 825.69, 825.06, 825.19, 825.22; 165/44, 41; 237/28, 12.3 R

[56] References Cited

U.S. PATENT DOCUMENTS

| | | | |
|---|---|---|---|
| 4,303,825 | 12/1981 | Jaronen | 219/201 |
| 4,304,548 | 12/1981 | Ruhaut et al. | 431/151 |
| 4,350,287 | 9/1982 | Richards | 237/12.3 A |
| 4,442,341 | 4/1984 | Lesquereux et al. | 219/201 |
| 4,738,242 | 4/1988 | Hart | 126/271.1 |
| 4,927,993 | 5/1990 | Simmons | 219/201 |
| 5,153,410 | 10/1992 | Barnes | 219/201 |

FOREIGN PATENT DOCUMENTS

| | | | |
|---|---|---|---|
| 2673579 | 9/1992 | France . | |
| 2640238 | 3/1978 | Germany | 70/431 |
| 2758849 | 7/1979 | Germany . | |
| 2850674 | 7/1980 | Germany | 219/201 |
| 2902925 | 7/1980 | Germany | 219/202 |
| 3009369 | 9/1981 | Germany . | |
| 3227402 | 2/1984 | Germany . | |
| 3639531 | 12/1988 | Germany . | |
| 524043 | 7/1972 | Switzerland | 219/201 |
| 248852 | 3/1926 | United Kingdom . | |

*Primary Examiner*—John A. Jeffery

[57] ABSTRACT

A remote control antifreeze device for a vehicle locking unit comprising a housing with an upper end having a bore centrally formed therein. A slot is formed between the bore and top surface thereof for allowing the bore to be situated about a conventional cylindrical locking unit. Also included is a helical heating element situated in a serpentine configuration within the housing adjacent to the locking unit and further secured thereto. A thin electrical insulator sheath is positioned about a surface thereof. The heating element is adapted to radiate heat energy upon the application of a voltage thereto. A control receiver switch is also situated within the housing. The control receiver switch comprises control circuitry coupled to a power source, a radio receiver element, and the heating element. The receiver control circuitry switch is adapted to allow the application of a voltage to the heating element upon the receipt of an actuation signal manually deployed by a portable transmitter unit.

1 Claim, 4 Drawing Sheets

REMOTE CONTROL ANTIFREEZE DEVICE FOR A VEHICLE LOCKING UNIT

BACKGROUND OF THE INVENTION

1. Field of the Invention

The present invention relates to a remote control antifreeze device for a vehicle locking unit and more particularly pertains to remotely unfreezing a locking unit with a unique concealed heating element and associated housing.

2. Description of the Prior Art

The use of locking unit antifreeze devices is known in the prior art. More specifically, locking unit antifreeze devices heretofore devised and utilized for the purpose of unfreezing a conventional locking mechanism are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,927,993 to Simmons a device for preventing freezing of lock cylinders including a heat conductive body member with an incandescent bulb removably mounted within a open top recess. U.S. Pat. No. 5,153,410 to Barnes discloses a method and apparatus for heating the cylinders of a vehicle door using a timing means. U.S. Pat. No. 4,442,341 to Lesquereux et al. discloses a electric antifreeze heating device for lock cylinders and mounting arrangement therefor. U.S. Pat. No. 4,303,825 to Jaronen; U.S. Pat. No. 4,738,242 to Hart; and U.S. Pat. No. 4,304,548 to Ruhart et al. are provided as being of general interest.

In this respect, the remote control antifreeze device for a vehicle locking unit according to the present invention substantially departs from the conventional concepts and designs of the prior art, and in so doing provides an apparatus primarily developed for the purpose of remotely unfreezing a locking unit with a unique concealed heating element and associated housing.

Therefore, it can be appreciated that there exists a continuing need for a new and improved remote control antifreeze device for a vehicle locking unit which can be used for remotely unfreezing a locking unit with a unique concealed heating element and associated housing. In this regard, the present invention substantially fulfills this need.

SUMMARY OF THE INVENTION

In view of the foregoing disadvantages inherent in the known types of locking unit antifreeze devices now present in the prior art, the present invention provides an improved remote control antifreeze device for a vehicle locking unit. As such, the general purpose of the present invention, which will be described subsequently in greater detail, is to provide a new and improved remote control antifreeze device for a vehicle locking unit apparatus and method which has all the advantages of the prior art and none of the disadvantages.

To attain this, the present invention essentially comprises a heated locking unit comprising a housing with an upper end. The upper end has a cylindrical configuration with a bore centrally formed therein. A slot is formed between the bore and a top surface thereof for allowing the bore to be situated about a conventional cylindrical locking unit and further secured thereto. A pair of protrusions extend upwardly from the top surface each with a threadedly lined aperture formed therein. For securing the housing to the locking unit, a coupling screw is included for providing screwable coupling between the apertures. The housing further includes a lower end with a rectangular configuration. The lower end has an interior space formed therein, an open front face, and a power line aperture formed on a lower surface thereof. The housing is preferably constructed of a heat conductive material. Also included is a helical heating element situated in a serpentine configuration within the upper end of the housing adjacent to the periphery of the bore. The heating element has a pair of free ends extending into the interior space of the lower end of the housing. A thin electrical insulator sheath is positioned about a surface thereof. The heating element is adapted to radiate heat energy upon the application of a voltage across the ends thereof. A control receiver switch is situated within the interior space of the housing. For receiving power, the control receiver switch is connected to a conventional vehicle battery via a power line extending through the power line aperture. The control receiver switch comprises a receiver element positioned in the open front face of the housing for receiving an actuation signal. The control receiver switch further comprises control circuitry coupled to the power line, the receiver element, and the ends of the heating element. The receiver control circuitry switch is adapted to allow current to flow between the power line and the heating element upon the receipt of the actuation signal.

Finally, a portable remote control transmitter is included with a rectangular configuration. The transmitter comprises a housing with an upper half, a lower half, and an interior space whereby the upper half and lower half are separatable for allowing access to the interior space. An eyelet is formed on an end of the housing for receiving a conventional key ring. A manually operated switch button is situated on the upper half of the housing and is adapted to activate upon the depression thereof. A light emitting diode is adapted to light upon the actuation thereof. Lastly, transmitter circuitry is situated within the housing and connected to the switch button, light emitting diode, and battery power source. The transmitter circuitry is adapted to transmit an actuation signal and further actuate the light emitting diode upon the activation of the switch button.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote control antifreeze device for a vehicle locking unit which has all the advantages of the prior art locking unit antifreeze devices and none of the disadvantages.

It is another object of the present invention to provide a new and improved remote control antifreeze device for a vehicle locking unit which may be easily and efficiently manufactured and marketed.

It is a further object of the present invention to provide a new and improved remote control antifreeze device for a vehicle locking unit which is of a durable and reliable construction.

An even further object of the present invention is to provide a new and improved remote control antifreeze device for a vehicle locking unit which is susceptible of a low cost of manufacture with regard to both materials and labor, and which accordingly is then susceptible of low prices of sale to the consuming public, thereby making such remote control antifreeze device for a vehicle locking unit economically available to the buying public.

Still yet another object of the present invention is to provide a new and improved remote control antifreeze device for a vehicle locking unit which provides in the apparatuses and methods of the prior art some of the advantages thereof, while simultaneously overcoming some of the disadvantages normally associated therewith.

Still another object of the present invention is to remotely unfreeze a locking unit with a unique concealed heating element and associated housing.

Lastly, it is an object of the present invention to provide a new and improved remote control antifreeze device for a vehicle locking unit comprising a housing with an upper end having a bore centrally formed therein. A slot is formed between the bore and top surface thereof for allowing the bore to be situated about a conventional cylindrical locking unit. Also included is a helical heating element situated in a serpentine configuration within the housing adjacent to the locking unit and further secured thereto. A thin electrical insulator sheath is positioned about a surface thereof. The heating element is adapted to radiate heat energy upon the application of a voltage thereto. A control receiver switch is also situated within the housing. The control receiver switch comprises control circuitry coupled to a power source, a radio receiver element, and the heating element. The receiver control circuitry switch is adapted to allow the application of a voltage to the heating element upon the receipt of an actuation signal manually deployed by a portable transmitter unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
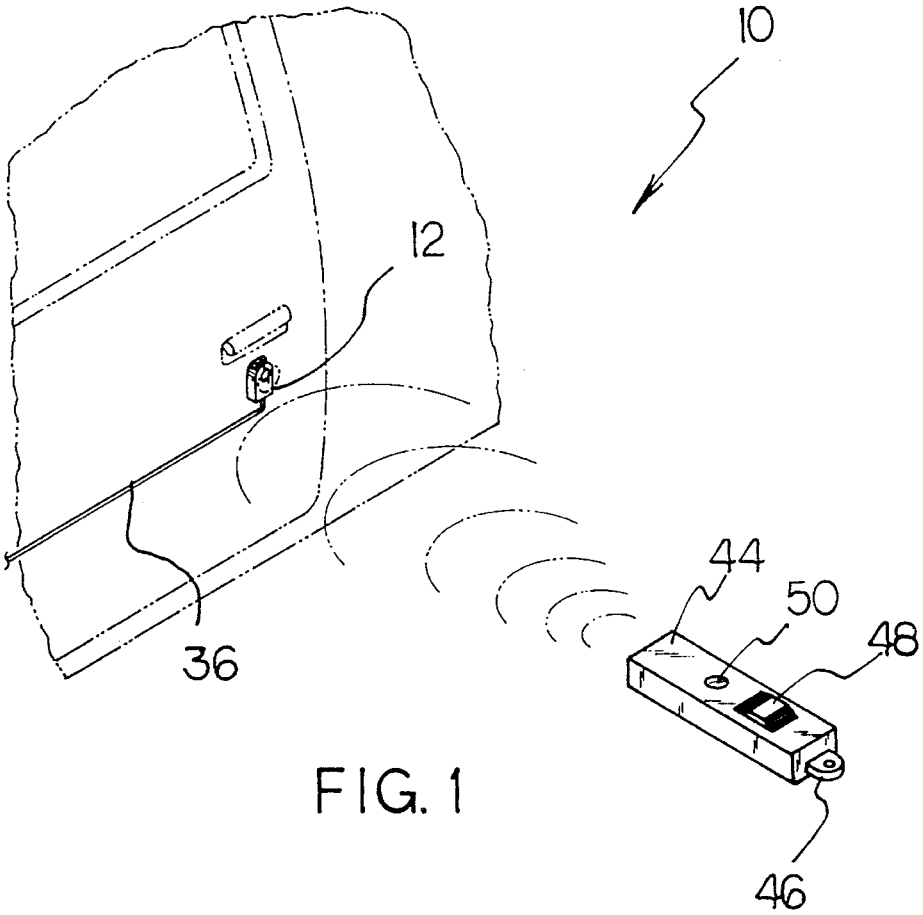
FIG. 1 is a perspective illustration of the preferred embodiment of the remote control antifreeze device for a vehicle locking unit constructed in accordance with the principles of the present invention.
Figure 2:
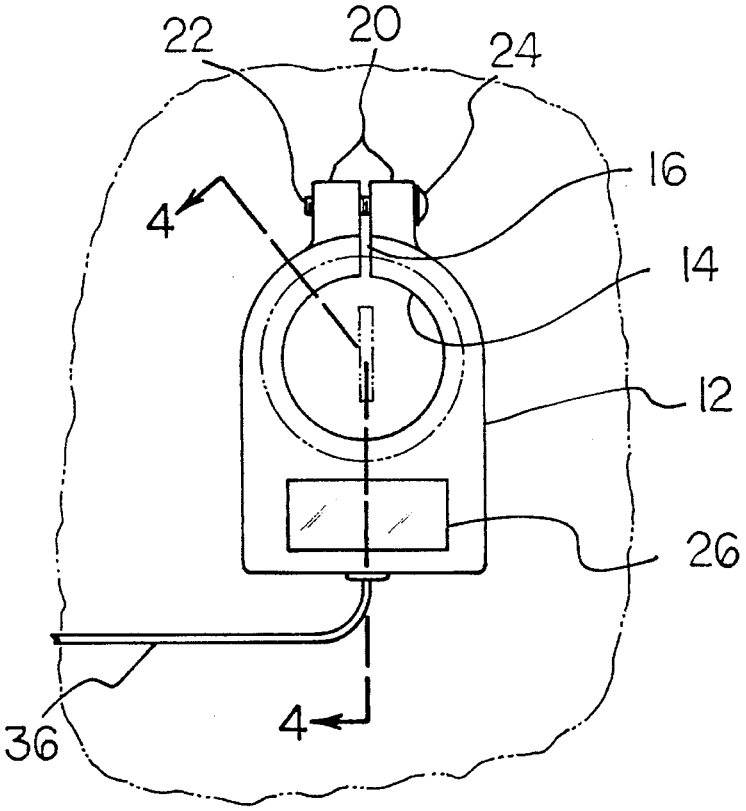
FIG. 2 is a front plan view of the housing and associated cylindrical locking unit of the present invention.
Figure 3:
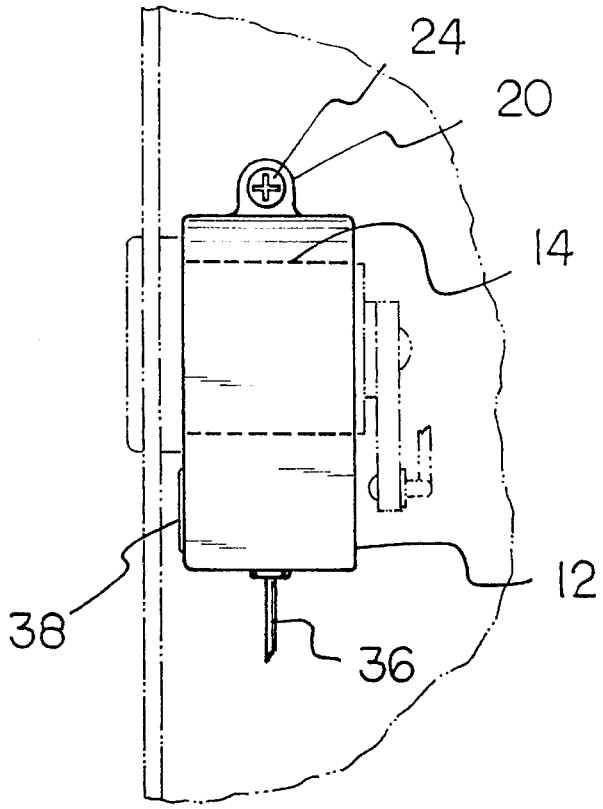
FIG. 3 is a side plan view of the housing of the present invention.
Figure 4:
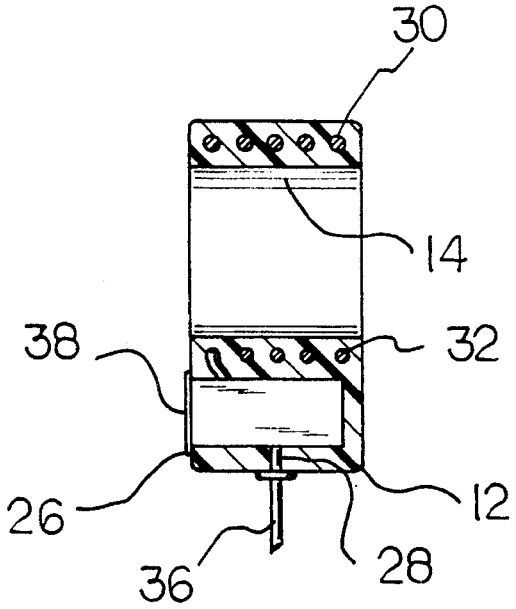
FIG. 4 is a cross-sectional view taken along line 4—4 depicted in FIG. 2.
Figure 5:
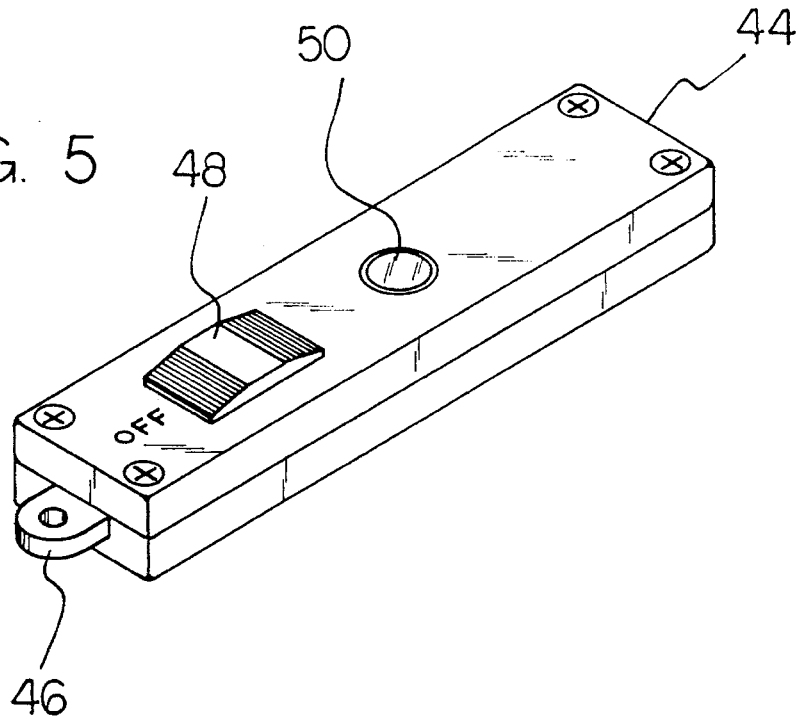
FIG. 5 is a perspective illustration of the remote control transmitter housing of the present invention.
Figure 6:
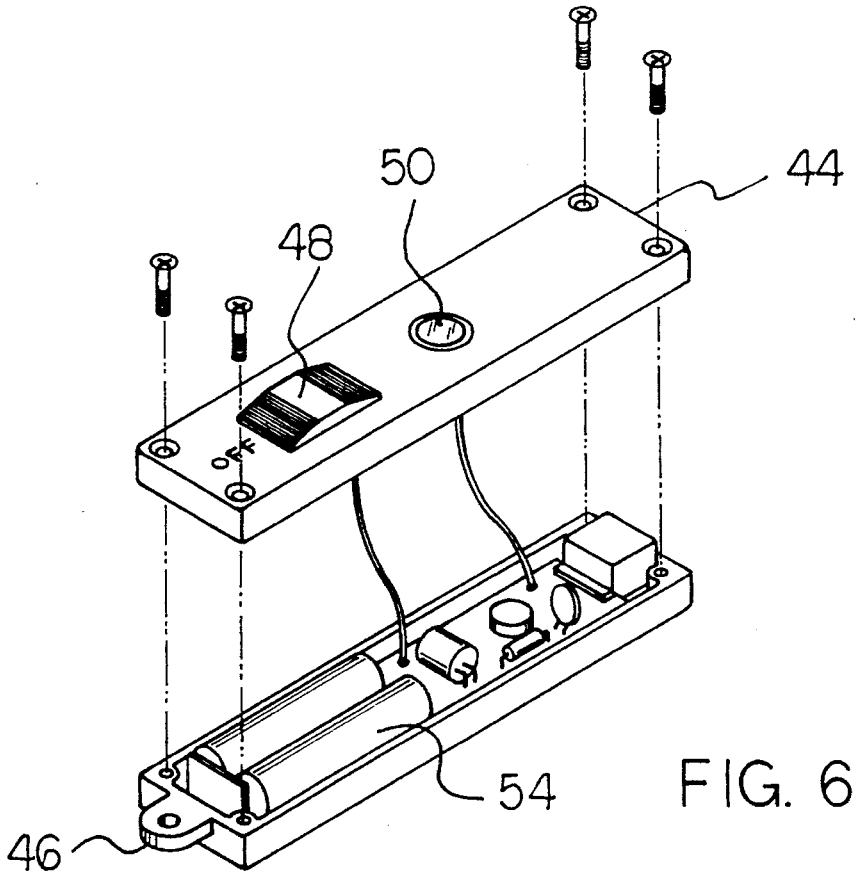
FIG. 6 is a perspective illustration of the remote control transmitter housing depicted in a disassembled orientation.
Figure 7:
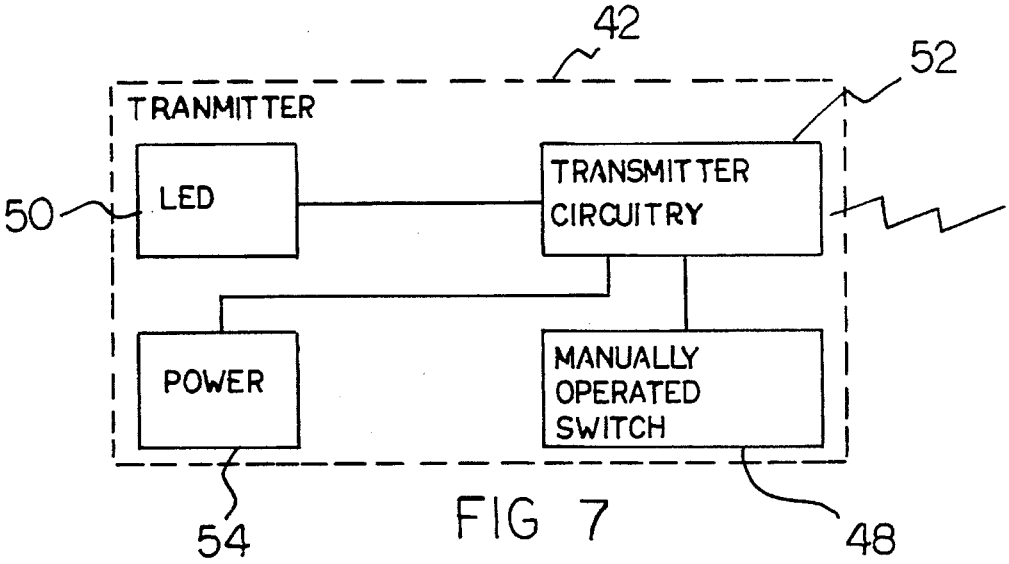
FIG. 7 is a schematic depicting the circuitry employed in the transmitter of the present invention.
Figure 8:
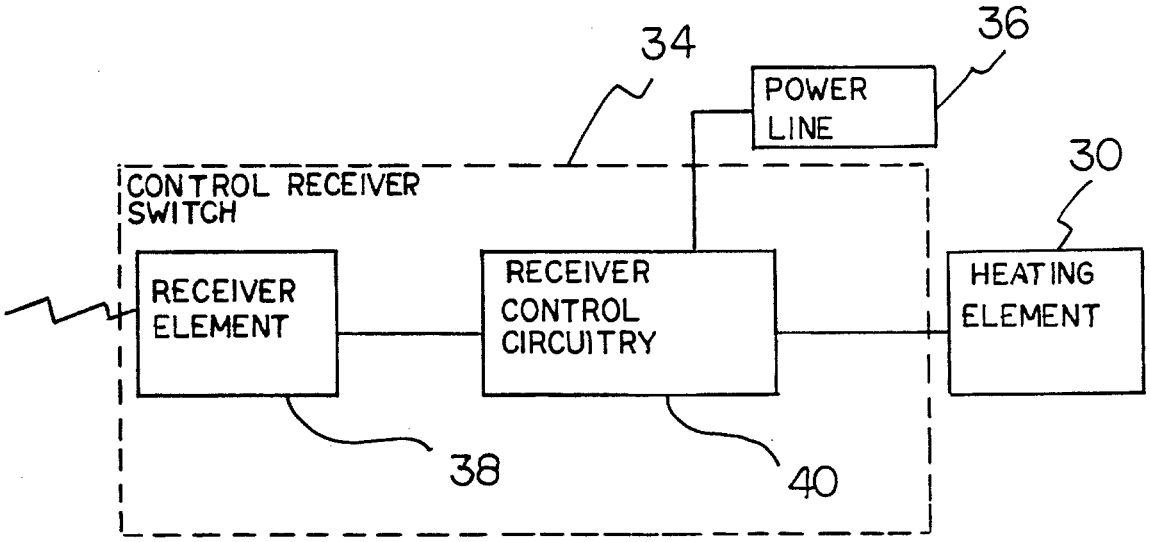
FIG. 8 is a schematic depicting the circuitry employed in the receiver of the present invention.

With reference now to the drawings, and in particular to FIG. 1 thereof, a new and improved remote control antifreeze device for a vehicle locking unit embodying the principles and concepts of the present invention and generally designated by the reference numeral 10 will be described.

The present invention, the new and improved remote control antifreeze device for a vehicle locking unit, is comprised of a plurality of components. Such components in their broadest context include a housing, heating element, control receiver switch, and remote transmitter. Such components are individually configured and correlated with respect to each other so as to attain the desired objective.

More specifically, it will be noted that the system 10 of the present invention includes a heated locking unit comprising a housing 12 with an upper end. The upper end has a cylindrical configuration with a bore 14 centrally formed therein. A slot 16 is formed between the bore and a top surface thereof for allowing the bore to be situated about a conventional cylindrical locking unit and further secured thereto. A pair of protrusions 20 extend upwardly from the top surface each with a threadedly lined aperture 22 formed therein. For securing the housing to the locking unit, a coupling screw 24 is included for providing a screwable coupling between the apertures. The depth of the upper end is sized to encompass the entire outer surface of the locking mechanism. The housing further includes a lower end with a rectangular configuration. The lower end has an interior space formed therein, an open front face 26, and a power line aperture 28 formed on a lower surface thereof. The housing is preferably constructed of a heat conductive material.

Also included is a helical heating element 30 situated in a serpentine configuration within the upper end of the housing adjacent to the outer surface of the bore. The heating element has a pair of free ends extending into the interior space of the lower end of the housing. The heating element extends from one of the free ends to one side of the slot and forms a U-shaped configuration thereat. The heating element from that point extends around the periphery of the bore to the other end of the slot where it forms another U-shaped configuration. In continuing to do so, the heating element may be situated adjacent to the entire outer surface of the locking mechanism thereby providing maximum heat transfer. A thin electrical insulator sheath 32 is positioned about a surface thereof. The heating element is adapted to radiate heat energy upon the application of a voltage across the ends thereof. The insulation affords maximum heat transfer to the locking unit by isolating the applied volt to the heating element which is ideally located adjacent thereto. The insulation is also adapted to deliver maximum heat transfer.

A control receiver switch 34 is situated within the interior space of the housing. For receiving power, the control receiver switch is connected to a conventional vehicle battery via a power line 36 extending through the power line aperture. A grommet is situated about the power line for preventing the severing thereof. The control receiver switch comprises a receiver element 38 positioned in the open front face of the housing for receiving an actuation signal. The control receiver switch further comprises control circuitry 40 coupled to the power line, receiver element, and ends of the heating element. The receiver control circuitry switch is adapted to allow current to flow between the power line and the heating element upon the receipt of the actuation signal.

Finally, a portable remote control transmitter 42 is included with a housing 44 having a rectangular configuration. The transmitter housing comprises an upper half, lower half, and interior space whereby the upper half and lower half are separatable for allowing access to the interior space. An eyelet 46 is formed on an end of the housing for receiving a conventional key ring. A manually operated switch button 48 is situated on the upper half of the housing and is adapted to activate upon the depression thereof. A light emitting diode 50 is adapted to light upon the actuation thereof. Lastly, transmitter circuitry 52 is situated within the housing and connected to the switch button, light emitting diode, and battery power source. The transmitter circuitry is adapted to transmit an actuation signal and further actuate the light emitting diode upon the activation of the switch button. At least one battery 54 is included for the powering of the transmitter.

In use, the switch button may be depressed within the proximity of the vehicle thereby allowing selective unfreezing of the associated locking mechanism. The heating element only radiates heat upon the continued depression of the button thus allowing a user to apply only a required amount of current to the heating element without excess. If possible, the key may be inserted within the locking mechanism and the user may continue to test the operability thereof while depressing the button. After the lock is freed, the button may be deactivated in order to preserve power.

The present invention provides a method of freeing frozen locks with a serpentine heating element uniquely disposed in a heat conductive housing. Such a method allows the unfreezing of the lock without the need for inserting the key within the keyhole which is sometimes impossible. Concealment is afforded by utilizing a remote control unit to actuate the device. The remote control antifreeze device may be employed in a vehicle, private airplane, or the like.

As to the manner of usage and operation of the present invention, the same should be apparent from the above description. Accordingly, no further discussion relating to the manner of usage and operation will be provided.

with respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved remote control antifreeze device for a vehicle locking unit comprising, in combination:

a heated locking unit comprising a housing having an upper end with a cylindrical configuration, the upper end having a bore formed therein, a slot formed between the bore and a top surface thereof for allowing the bore to be situated about a conventional cylindrical locking unit and further secured thereto, a pair of protrusions extending upwardly from the top surface with a threadedly lined aperture formed in each of the protrusions, and a coupling screw for providing screwable coupling between the apertures thereby allowing the housing to be secured to the locking unit, wherein the upper end has a depth sized to encompass the entire outer surface of the locking mechanism; and a lower end with a rectangular configuration, the lower end having an interior space formed therein, an open front face, and a power line aperture formed on a lower surface thereof, the housing constructed of a heat conductive material;

a helical heating element situated in a serpentine configuration within the upper end of the housing adjacent to a periphery of the bore, the heating element having a pair of ends extending into the interior space of the lower end of the housing and a thin electrical insulator sheath positioned about a surface thereof, the heating element adapted to radiate heat energy upon the supply of current thereto, wherein the heating element extends from one of the free ends to one side of the slot and forms a U-shaped configuration thereat and further extends around the periphery of the bore to the other end of the slot where the heating element forms another U-shaped configuration for providing maximum heat transfer;

a control receiver switch situated within the interior space of the housing and connected to a conventional vehicle battery via a power line extending through the power line aperture with a grommet situated about the power line for precluding the severing thereof, the control receiver switch comprising a receiver element positioned in the open front face of the housing for receiving an actuation signal, the control receiver switch further comprising control circuitry coupled to the power line, the receiver element, and the ends of the heating element, the receiver control circuitry switch adapted to supply current to the heating element upon the receipt of the actuation signal; and a portable remote control transmitter with a rectangular configuration, the transmitter comprising a housing with an upper half, a lower half, and an interior space whereby the upper half and lower half are separatable for allowing access to the interior space, an eyelet formed on an end of the housing for receiving a conventional key ring, a manually operated switch button situated on the upper half of the housing and adapted to activate upon the depression thereof, a light emitting diode adapted to light upon the actuation thereof, and transmitter circuitry situated with in the housing and connected to the switch button, light emitting diode, and battery power source, the transmitter circuitry adapted to transmit an actuation signal and further actuate the light emitting diode only during the activation of the switch button.

* * * * *